United States Patent [19]

Zweig et al.

[11] Patent Number: 5,014,592

[45] Date of Patent: May 14, 1991

[54] MULTI-LUG BREECH MECHANISM

[75] Inventors: John E. Zweig, Poestenkill; John P. Kehn, Troy; Michael J. Glennon, Loudonville, all of N.Y.

[73] Assignee: The United States of America as represented by the Secretary of the Army, Washington, D.C.

[21] Appl. No.: 459,905

[22] Filed: Jan. 2, 1990

[51] Int. Cl.[5] ..... F41A 3/10

[52] U.S. Cl. ..... 89/24

[58] Field of Search ..... 89/24, 4.2, 23; 42/23

[56] References Cited

U.S. PATENT DOCUMENTS

| | | | |
|---|---|---|---|
| 617,110 | 1/1899 | Lynch | 89/24 |
| 898,840 | 9/1908 | Dawson et al. | 89/24 |
| 1,232,090 | 7/1917 | Rimailho | 89/4.2 |
| 1,393,353 | 10/1921 | Driggs | 89/4.2 |
| 2,613,576 | 10/1952 | Finn | 89/24 |
| 2,789,471 | 4/1957 | Bluford et al. | 89/4.2 |

FOREIGN PATENT DOCUMENTS

| | | | |
|---|---|---|---|
| 26371 | of 1902 | United Kingdom | 89/24 |
| 5974 | of 1913 | United Kingdom | 89/24 |

*Primary Examiner*—Charles T. Jordan
*Assistant Examiner*—Stephen Johnson
*Attorney, Agent, or Firm*—Robert P. Gibson; Edward Goldberg; Michael C. Sachs

[57] ABSTRACT

A breech mechanism embodies a multi-lug sliding breech block having a plurality of pairs of lugs. At the instant before firing, the bearing surfaces of at least one pair of lugs are spaced a predetermined distance apart from the bearing surfaces of the respective threads, or lugs, of the breech ring. When the cannon is fired, a reactive force acting on the breech block elastically deforms the material of the ring and block, forcing all the bearing surfaces into an abutting contact relationship whereby the stresses produced within the material of the mechanism are more uniformly distributed throughout the breech ring and the breech block thereby increasing the service life of the mechanism.

4 Claims, 6 Drawing Sheets

MULTI-LUG BREECH MECHANISM

GOVERNMENTAL INTEREST

The invention described herein may be manufactured, used, and licensed by or for the government of the United States of America for governmental purposes without the payment to us of any royalty thereon.

BACKGROUND OF THE INVENTION

1. Field of the Invention

This invention relates to a slide block breech mechanism assembly for cannon. This mechanism embodies a multi-lug breech block and breech ring to minimize regions of high firing stresses in each component without increasing the size or weight of the assembly.

2. Description of the Prior Art

Heretofore, when a cannon was designed to enable it to deliver a projectile over a greater distance and, or, to enable a fired projectile to have greater armor penetration, an interrupted slotted screw-type breech mechanism was often used. This type of mechanism had the advantages of strength, reduction of weight in the breech section, uniform distribution of stresses produced by the powder pressure, and adaptability to a method of securing obturation with separately-loaded ammunition.

However, when a rapid fire cannon is required, one usually employs a sliding-wedge type of breech mechanism assembly. This assembly is normally of simple construction and employs a rectangular wedge-shaped block securely seated in a slot in the breech ring, with its longitudinal axis perpendicular to the bore of the cannon tube. However, this assembly must necessarily be of a heavy section to provide the strength necessary to withstand the highly concentrated firing stresses produced therein.

Reliability and durability must be considered to provide a cannon to meet the condition of hard service life with a minimum of down time. Fatigue crack initiation in both the breech ring and the slide block must be minimized to provide a long service life of the breech mechanism assembly. Therefore, it is necessary for the stresses produced in the block during firing to be distributed throughout the entire block as equally as possible. The force or load acting on the block must be transmitted to the breech ring in a manner that minimizes crack initiation in the ring.

A prior art conventional type of slide block breech mechanism comprises a T-shaped slide block. Two oppositely disposed integral lugs have respective bearing surfaces which comprise, in part, the rear surface area of the block. Oppositely disposed integral flanges of the breech ring have bearing surfaces which are in contact with respective bearing surfaces of the lugs when the breech block is in the locked position for firing. The flanges of the ring retain the block within the breech ring during firing of a cannon tube affixed to the forward portion of the ring. The surfaces of the lugs and flanges may be machined in a manner that when the respective bearing surfaces slide over each other, the block is wedged forward to force a cartridge shell into the chamber of the cannon tube. This action also results in a tight fit between the forward face of the block and the breech end of the cannon tube. In a similar manner, the disengagement of the block from the ring will move the block rearward and away from the breech of the tube.

When the cannon is fired, a reactive force resulting from the burning propellant causes the block to move rearward. The force, or load, is immediately transferred to the flanges of the ring by means of the respective pairs of contacting bearing surfaces. The block is slidably mounted in a cavity in the breech ring with very little clearance in order to provide smooth and continuous operation of the block. Only small radius fillets can be provided in areas of high stress concentration.

However, continuous use of the mechanism assembly produces continuous cycling of stress concentration in the small fillets and failure occurs due to metal fatigue thereby prematurely terminating the reliable useful life of the breech ring.

M. A. Lynch, in U.S. Pat. No. 617,110, teaches a breech mechanism for ordnance embodying a plurality of ribs or flanges slidably mounted in the respective grooves of the breech lugs. The bearing contact surface of each rib and the bearing contact surface of its respective groove comprise substantially all of the surface area of the respective lug and groove.

Colonel Thomas J. Hayes in "Elements of Ordnance" copyrighted in 1938 by John Wiley and Son, New York, teaches at page 232, FIG. 4, a similar type of breech mechanism as Lynch.

In all instances, the breech block bearing surface of each rib, flange, or lug is in contact with the respective bearing surface of the breech ring groove, or recess, prior to, and at the moment of firing. When the cannon is fired, the force, or load, acting on the slide block is immediately transmitted to the ring through each contact surface. The force, or load, transmitted produces unequal, and therefore excessive, stress concentrations in both the breech ring and block. Excessive stress concentrations result in premature failure of the breech mechanism.

It is therefore an object of this invention to provide a new and improved slide block breech mechanism which overcomes the deficiencies of the prior art by designing a load distribution which tends to equalize, and therefore minimize, the stress concentrations.

It is also an object of this invention to provide a new and improved slide block breech mechanism which embodies a multi-lug configuration wherein only a portion of each lug is inserted into and physically contacts a bearing surface of the mating thread, or lug, of the breech ring.

Another object of this invention is to provide a new and improved slide block breech mechanism wherein the slide block and breech ring includes a plurality of pairs of integral lugs wherein the configuration of each lug in each pair is the same, but of different configuration than each of the other pairs of lugs.

A further object of this invention is to provide a new and improved slide block breech mechanism wherein the bearing surfaces of at least one pair of breech block lugs is not initially in an abutting contact relationship with their mating ring bearing surfaces. These bearing surfaces contact under loading and deformation of the structure in such a manner as to cause a favorable stress distribution.

A still further object of this invention is to provide a new and improved slide block breech mechanism embodying a multi-lug slide block having integral means for tying together the rear portions of the two sides of the breech ring.

Other objects of this invention will, in part, be obvious and will, in part, appear hereinafter.

BRIEF DESCRIPTION OF THE INVENTION

In accordance with the teachings of this invention there is provided a breech mechanism embodying a multi-lug breech block and ring. A cavity formed in the breech ring has walls configured to define an interrupted internal thread of a modified buttress form. The breech block comprises a body of material having a predetermined value of compliance and two side surfaces. The side surfaces are configured to define a plurality of pairs of laterally extending integral lugs projecting outwardly from the center of the body. The configuration of the lugs define an interrupted external thread of a modified buttress form.

The breech block is slidably inserted into and withdrawn from the cavity of the breech ring. When inserted into the ring, and in the closed and locked position for firing, the bearing surface of each lug of at least one pair of the plurality of pairs of lugs of the block is separated by a gap of a predetermined distance from the bearing surface of the respective thread, or lug, of the breech ring. Meanwhile, the bearing surface of each lug of a second pair of the plurality of pairs of lugs of the block are in physical contact with the bearing surface of the respective thread, or lug, of the breech ring.

Upon firing the cannon, a reactive force, generated by burning propellant of the shell fired, acts on the forward face of the breech block. The contacting bearing surfaces of one pair of lugs restricts the rearward movement of the breech block causing the ring-block structure to deform. This causes the gaps in the remaining lugs to begin to decrease and eventually close. Once the gap is closed, a portion of the reactive force is redistributed through the newly mated lugs. The result is a more equal distribution of the reactive force to the breech ring and a more uniform distribution of stress throughout both the block and the ring.

As the projectile travels toward the muzzle end of the cannon tube and is expelled therefrom, the reactive force decreases in magnitude and becomes zero. The gaps between the originally spaced bearing surfaces begins to reappear and elastically recovers its original predetermined distance at the end of the firing cycle.

Adjacent pairs of lugs may be of different sizes, have bearing surfaces inclined at different angles, and have the same or different bearing heights. The pitch between adjacent threads, or lugs, may be the same or different. One pair of lugs may be configured to provide an integral tie bar for the novel breech mechanism.

DESCRIPTION OF THE DRAWINGS

With reference to FIG. 1 there is shown a breech mechanism 10 comprising a breech ring 12 and a sliding breech block 14. The breech ring comprises a body of material suitable for its intended use with a cannon tube 40 affixed to the forward end thereof. The material may be a gun steel having suitable chemical and mechanical properties. The body has a longitudinal axis 16, and an exterior surface comprising a front surface 18, a rear surface 20, two major opposed surfaces which are side surfaces 22 and 24 respectively, and two major spaced opposed surfaces which are top and bottom surfaces 26 and 28 respectively.

Figures 1, 1A:
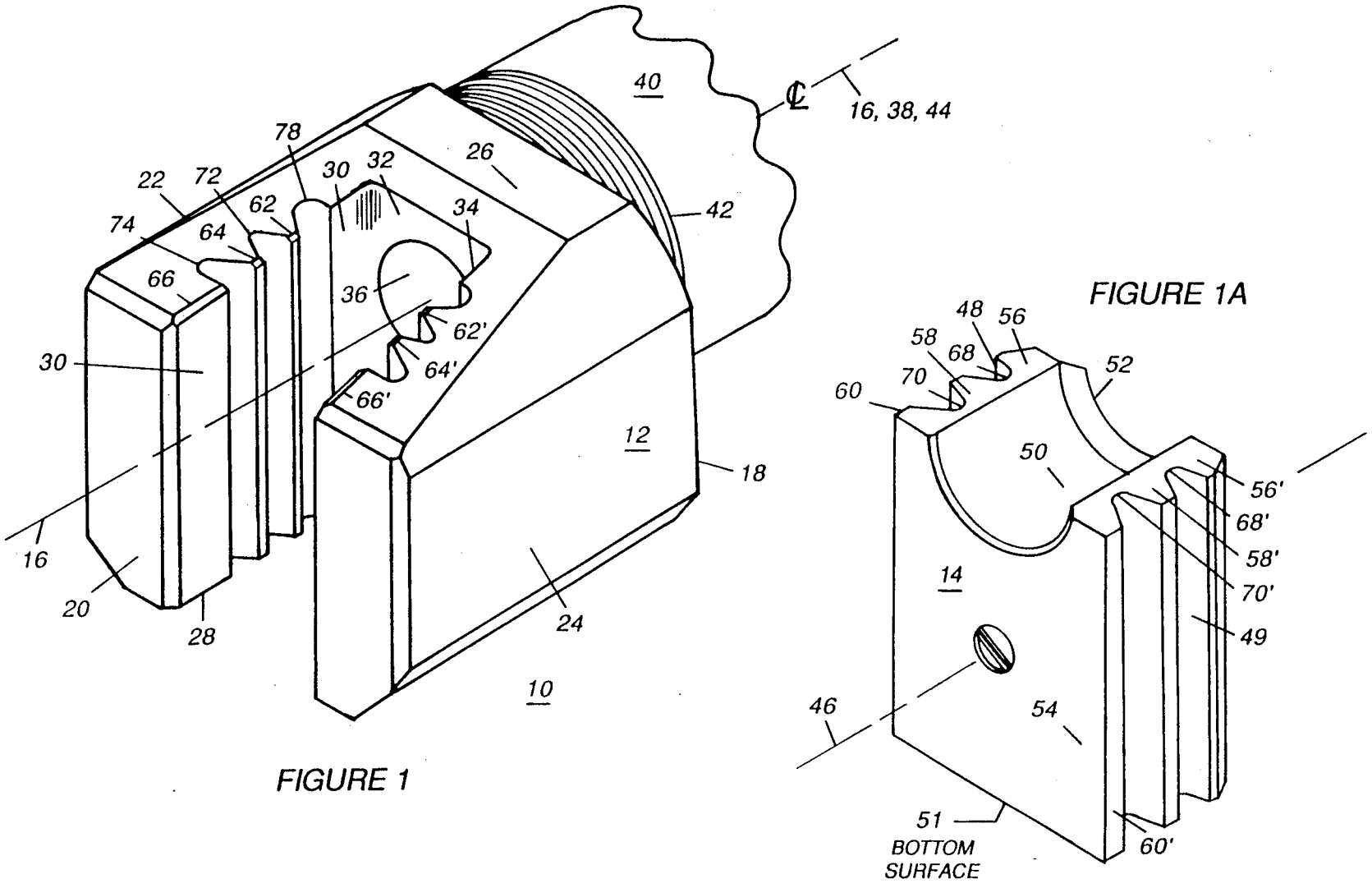
FIG. 1 is an exploded perspective view of a breech mechanism made in accordance with the teachings of this invention.

Walls 30,32, and 34 are formed in, and extend entirely through, the body from the top surface 26 to the bottom surface 28 and include a portion of the rear surface 20. The surfaces of walls 30,32, and 34 are coextensive with each other and define a cavity having an opening in the rear surface 20 of the body. Such a configuration for the body of the ring 12 is known as an open end breech ring. As illustrated, the walls 30 and 34 are substantially parallel to each other and equally spaced from, and parallel to, a vertical plane containing the axis 16. Walls 30 and 34 are suitably formed to provide ring 12 with an interrupted internal thread of buttress form suitably modified for operation of the mechanism 10.

A wall 36 is formed in, and extends entirely through, the forward portion of the body of ring 12, including wall 32 and front surface 18, to define a passageway therein. The passageway has a longitudinal axis 38 which is coincident with axis 16. The passageway provides a means for inserting a cannon tube 40 into the front portion of the ring 12.

A cannon tube 40 is affixed to the ring 12 by suitable means such, for example, as by a threaded engagement of an externally threaded portion 42 of the breech end of the tube 40 with an internally threaded portion of the passageway defined by wall 36. The tube 40 has a longitudinal axis 44 which is coincidental with axes 16 and 38.

The sliding breech block 14 comprises a second body of material having a latitudinal axis 46 and an exterior surface comprising two spaced major surfaces which are first and second side surfaces 48 and 49, respectively, two spaced major surfaces which are top and bottom surfaces 50 and 51, respectively, a front surface 52, and a rear surface 54.

The latitudinal axis 46 is coincidental with axes 16, 38 and 44. The top surface 50 and the bottom surface 51 are each substantially parallel to a horizontal plane containing the axis 46. The side surfaces 48 and 49 are each equally spaced from, and substantially parallel to a vertical plane containing the axis 46. The side surfaces 48 and 49 are configured to provide a plurality of pairs of integral laterally extending lugs 56 and 56', 58 and 58', and 60 and 60' projecting outwardly from the center of the body and configured to form an interrupted external thread of buttress form suitably modified for operation of the mechanism 10.

The material comprising the second body may be the same as, or different from, the material of the first body. In order to meet the material strength requirements necessary to achieve greater durability of the mechanism 10, a gun steel of the same chemical composition and the same range of mechanical properties is desirable for the two bodies.

The configuration of the threads enable the block 14 to translate, or slide, in ring 12 from the "OPEN AND LOAD" position to the "CLOSED AND LOCKED" position. During this translation, the sliding action of one or more pairs of threads, or lugs, will cause the block 14 to be wedged forward resulting in a secure chambering of the round prior to firing. After firing, the block will return to the "OPEN AND LOAD" position and will simultaneously wedge rearward bringing the cartridge, or shell with it. This action frees the cartridge from the chamber making it easy to eject from the the cannon.

Figure 2:
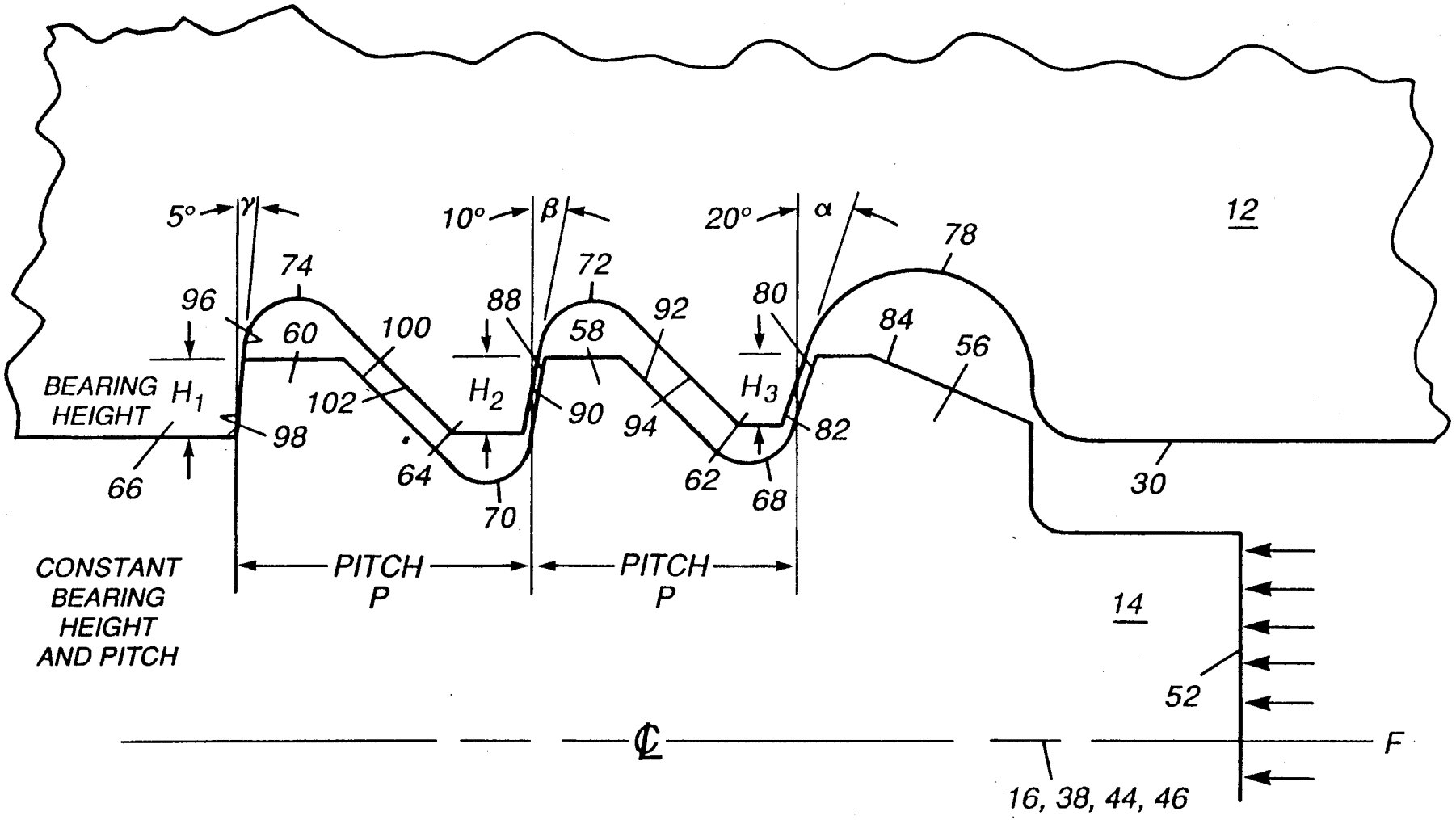
FIGS. 2 and 3 are partial top planar views of alternate embodiments of the breech mechanism of FIG. 1.

Referring now to FIG. 2, in addition to FIG. 1, there is shown one arrangement for the modified buttress thread configuration for both the ring 12 and the block 14 when the mechanism 10 is in a "CLOSED AND LOCKED" condition immediately prior to firing the cannon. The standard terminology for threads of buttress form may be found in "Machinery's Handbook", a well known reference for mechanical engineers and anyone skilled in the related arts of mechanical engineering. It is to be understood that block 14 is symmetrical about a vertical plane containing axis 46 and therefore that which is taught relating to lugs 56, 58, and 60 applies equally to the respective lug of each pair 56 and 56', 58 and 58', and 60 and 60'. In order to achieve a more favorable stress distribution, it is desirable that the configuration of one or more pair of threads, or lugs, be different than that of one or more pair of the remaining threads or lugs. The thread pitch planes for the internal ring threads and external block threads are coincidental.

In FIG. 2, both the bearing height and the pitch P of the modified buttress thread form are constant. The internal threads of the ring 12 are comprised of threads, or lugs, 62, 64, and 66 and their respective threads, or lugs, 62', 64', and 66' (not shown). The external threads of the block 14 are comprised of lugs 56 and 56', 58 and 58', and 60 and 60'. The threads of ring 12 and block 14 are configured so as not to fully engage each other. This allows roots 68, 68', 70, 70', 72, 72', 74, 74', 78 and 78' to be of generous radius in order to minimize the stress concentrations and subsequent initiation of a fatigue crack thereat. The configurations of the ring and block threads also provide for ample crest clearance during deformation under firing loads.

Bearing surface, or pressure flank 80 of lug 56 is oriented opposed to, and predeterminately spaced from respective bearing surface, or pressure flank 82 of lug 62. The surface areas of flanks 80 and 82 are approximately equal to each other and of sufficient size to transmit a predetermined load from the block 14 to the ring 12 by way of lugs 56 and 62. Flanks 80 and 82 are inclined a predetermined angle "A" of from 19.8 to 20.2 degrees to minimize the stress concentrations under load. Respective clearance flanks 84 of lug 56 of block 14 and root 78 of ring 12 are designed to remain spaced apart during the complete firing cycle of the cannon. The aforementioned description is also applicable to pressure flanks 80' and 82', clearance flank 84' and root 78'.

In a similar manner, bearing surface, or pressure flank 88 of lug 58 is oriented opposed to, and predeterminately spaced from respective bearing surface, or pressure flank 90 of lug 64. The predetermined distance is usually less than the distance between pressure flanks 80 and 82. The surface areas of flanks 88 and 90 are approximately equal to each other and of sufficient size to transmit a predetermined load from the block 14 to the ring 12 by way of lugs 58 and 64. The pressure flanks are also inclined a predetermined angle "B", usually less than the value of the inclination angle of flanks 80 and 82. For example, angle "B" may range from 9.8 to 10.2 degrees. Clearance flanks 92 of lug 58 and 94 of lug 62 are designed to remain spaced apart during the complete firing cycle of the cannon. The aforementioned description is also applicable to pressure flanks 88' and 90' and clearance flanks 92' and 94'.

Pressure flank 98 of lug 60 is in an abutting contact relationship with pressure flank 96 of lug 66 before, during and after firing the cannon. This abutting contact relationship is required to guide the block as it moves from the "CLOSED AND LOCKED" to the "OPEN AND LOAD" position. Pressure flanks 96 and 98 are inclined a predetermined angle "G" of from 4.8 to 5.2 degrees to minimize the stress concentrations under load. Clearance flanks 100 of lug 60 and 102 of lug 64 are also designed not to interfere with one another under load. The aforementioned description is also applicable to pressure flanks 96' and 98', and clearance flanks 100' and 102'.

Upon firing of the cannon, the burning propellant forces a projectile through the tube 40 and out of the muzzle end. Simultaneously, it produces a reactive force, or load, "F" on the forward surface 52 of block 14 which forces the block rearward in the ring 12. However, the pair of lugs 66 and 66' of the ring negate the rearward movement. The resulting deformation of the ring 12 and the block 14 forces all initially spaced pressure flanks of the block into an abutting contact relationship with their mating pressure flanks in the ring. The achievement of this contact relationship permits predetermined portions of the applied load "F" to be channeled through each pair of mating lugs in a manner that results in a more uniform stress distribution in the block 14 and ring 12 than in the prior art breech mechanism. When designed properly, initiation of a fatigue crack is reduced substantially and the block 14 and the ring 12 has a service life of greater than five times that of prior breech mechanisms.

The aforementioned sequence of events occurs immediately upon firing of the cannon as the pressure in the firing chamber of tube 40 increases and reaches its peak. Once this pressure starts decreasing, the force, or load, "F" decreases accordingly and the ring 12 and block 14 begin to recover their original shapes. After the projectile emerges from the muzzle of tube 40, all the pressure is released and the load "F" on surface 52 is removed. The block 14 and ring 12 recover their original shape and the initial spacings between pressure flanks 80 and 82, 80' and 82', and 88 and 90, and 88' and 90', have reappeared. The block 14 is released from the "CLOSED AND LOCKED" position and slidably translated to the "OPEN AND LOAD" position. The cartridge or shell is then withdrawn and discarded from the tube 40.

Figure 3:
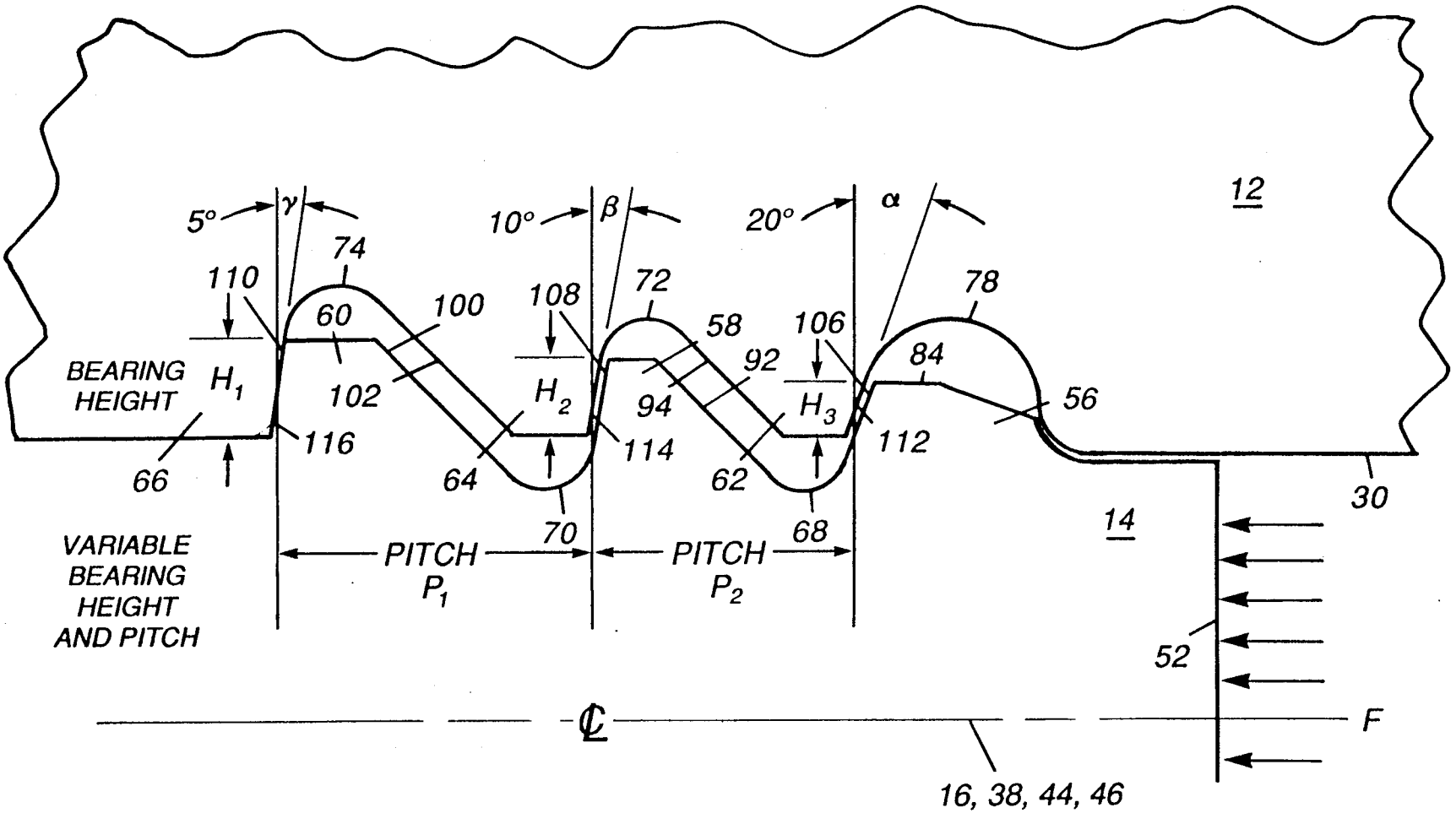

FIG. 3 is illustrative of an alternate embodiment of the breech mechanism 10. Each of the elements which has the same reference numeral as the corresponding element and reference numeral in FIGS. 1 and 2 are the same, and function in the same manner, as that element. The alternate embodiment consists of a different bearing height H1, H2 and H3 for each pressure flank and the pitch is variable as indicated by $P_1$ and $P_2$. Each of the pressure flanks 106 and 106' of respective lugs 56 and 56', and 112 and 112' of respective lugs 62 and 62' have the same surface area which is a smaller surface area than pressure flanks 108 and 108' of respective lugs 58 and 58', and pressure flanks 114 and 114' of respective lugs 64 and 64'. Similarly, the surface area of pressure flanks 108 and 108', and 114 and 114' are equal to each other but are smaller than the surface area of each of the pressure flanks 110 and 110' of respective lugs 60 and 60' and pressure flanks 116 and 116' of respective lugs 66 and 66'. Pitch $P_1$ is illustrated as being greater than $P_2$.

In each of the embodiments of FIGS. 2 and 3, it is the configuration and compliance of the material which enables one to achieve a more uniform stress distribution in both the ring and block during the firing cycle. Usually, each pair of lugs of the breech ring and the slide block is different from each of the other pairs of lugs. The configuration criteria for each pair of lugs is determined by their function, their position relative to the other lugs and their position relative to the force, or load "F".

As the force, or load, "F" increases, the greater the lateral displacement of the lugs 66 and 66' becomes during firing. The lugs 66 and 66' might be displaced sufficiently to reduce the effective contact area of pressure flanks 110,110', 116 and 116'. The resulting localized and uneven stress distributions occurring in the ring 12 and block 14 may lead to premature failure of the mechanism 10.

Figure 4:
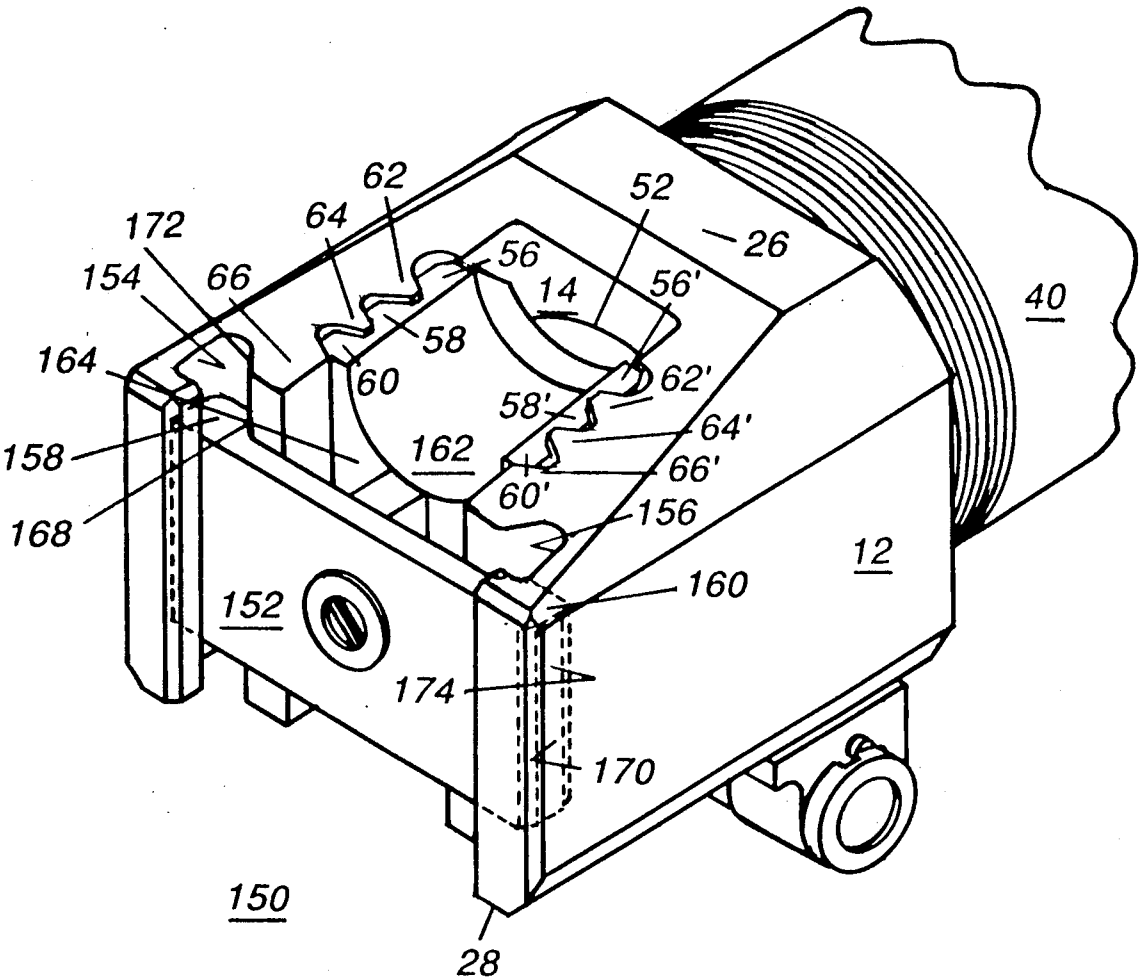
FIG. 4 is a perspective view of the breech mechanism of FIG. 1 embodying a separate tie-bar.

With reference to FIG. 4, there is illustrated a breech mechanism 150 which is a modification of the breech mechanism 10 to minimize the aforementioned occurrence. All the elements of the mechanism 150 identified by the same reference numeral as in FIGS. 1, 2, and 3 are the same, and function inthe same manner, as heretofore described. The ring 12 comprises a larger body of material to provide for the inclusion of a tie bar 152. Walls 154 and 156 are formed in the rear portion of ring 12 to define opposed grooves therein which extend entirely through the body of material from top surface 26 to bottom surface 28.

The tie bar 152 has two oppositely disposed integral end portions 158 and 160 configured to be slidable within, and to engage the respective grooves 154 and 156. The end portions 158 and 160 may be configured to have a modified buttress form. Suitable means, such, for example, as a mounting bar 162, joins the tie bar 152 to the rear surface of block 14. The mounting bar 162 may be an integral web portion of the rear surface 164 of the block 14. The tie bar 152 may be affixed to the mounting bar 162 by suitable means, such, for example, as by a bolt. The material comprising each of the bars 152 and 162 should be the same as, or very similar to, the material compositions of the block 14 and the ring 12. The movement of the tie bar 152 relative to the ring is in conjunction with, and the same direction as, the movement of block 14.

The end portions 158 and 160 and the respective grooves 154 and 156 have respective pressure flanks 168, 170, 172 and 174, which are urged into an abutting contact relationship by the force, or load, "F" acting on the face 52 of block 14 during firing of the cannon. The distribution of the force, or load, "F" throughout both the block 14 and the ring 12 causes the rear portion of the ring 12, including lugs 66 and 66', to move laterally apart and to bring each of the two respective pairs of pressure flanks, 168 and 172, and 170 and 174, into an abutting contact relationship. This abutting contact relationship restrains further lateral movement of the rear portion of ring 12. The pressure flanks, 168 and 172, and 170 and 174 may also be tipped forward at an angle of from 1.23 to 1.27 degrees to allow wedging movement of the block 14 during closing and opening of the breech.

The breech mechanism 150 overcomes the problem of the open type breech ring spreading apart during the firing of the cannon. However, the need of additional elements, such as the mounting and tie bars, increases the mass of material required.

Figure 5:
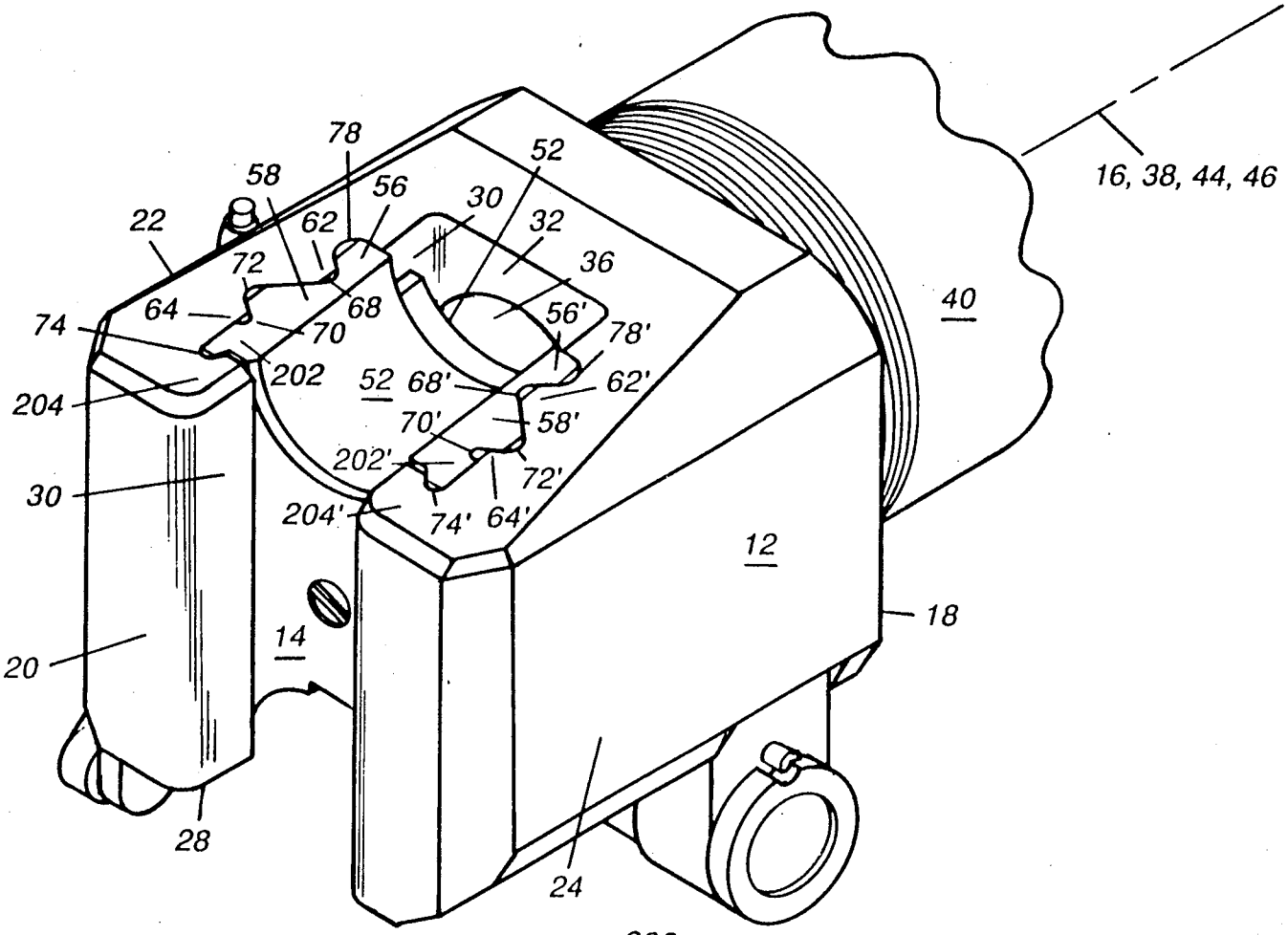
FIG. 5 is a perspective view of the breech mechanism of FIG. 1 embodying an integral tie bar.
Figure 6:
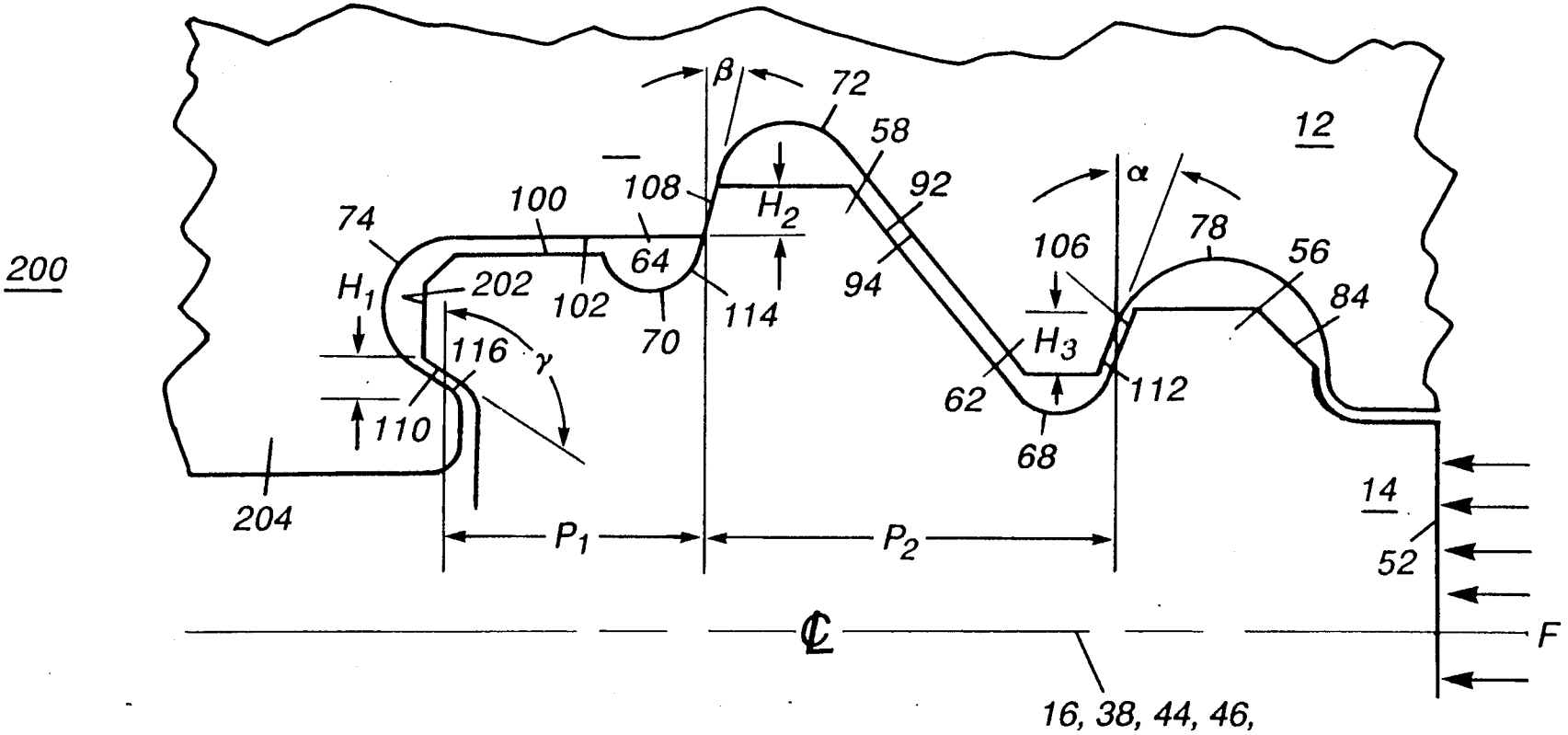
FIG. 6 is a partial top planar view of the breech mechanism of FIG. 5.

Referring now to FIGS. 5 and 6, there is shown a breech mechanism 200 which is an alternate embodiment of the breech mechanism 150. All of the elements which are the same, and function in the same manner, as the elements in the previous figures are denoted by the same reference numerals. The lugs, or threads 202, 202', 204 and 204' are reconfigurations of lugs, or threads 60, 60', 66 and 66'. This lug configuration provides the mechanism 200 with an integral tie bar thereby eliminating the need for the tie bar 152 of mechanism 150. The block 14 has been modified to provide the lugs 202 and 202' which extend laterally outward from the center of the block as well as extending toward the rear of the body. The lugs 204 and 204' are a reconfiguration of threads, or lugs, 66 and 66' of the breech ring 12 of mechanism 10 modified to accommodate lugs 202 and 202'.

When the slide block 14 is in a closed and locked position just prior to firing the cannon, the pressure flanks of lugs 58 and 58' are in an abutting contact relationship with the pressure flanks of the respective threads, or lugs, 64 and 64'. A gap of a predetermined width, or distance, exists between the opposed pressure flanks of lugs, or threads, 56 and 62, 56' and 62', 202 and 204, and 202' and 204'.

Upon firing the cannon, almost instantaneously a load, or force, "F", resulting from the burning of the propellant, is applied to the front surface 52 of the block 14. The lugs 58 and 58' and the threads, or lugs, 64 and 64' transmit this force from the block 14 to the ring 12. The ring and block begin to deform under this load, and when "F" is of sufficient magnitude, the gaps between lugs 56 and 62, and 56' and 62' close and selected portions of the load "F" are transferred via the pressure flanks of the engaged lugs of the block 14 with the respective threads, or lugs, of the ring 12 (56 and 62, 56' and 62', 58 and 64, and 58' and 64'). A more uniform stress distribution is achieved than than in prior art breech mechanisms.

Simultaneously, this action of the load "F" is causing the rear lugs 204 and 204' of the ring 12 to be displaced laterally until the pressure flanks thereof engage the pressure flanks of respective lugs 202 and 202' of the block 14. This engagement restrains further lateral displacement and is illustrative of the integral tie bar embodiment of the mechanism 200.

As the projectile traverses the length of the tube 40, the load, or force, "F" decreases and both the ring and block begin to recover their original configurations causing the gaps between the pressure flanks to reappear. After the projectile exits the muzzle of tube 40, "F" diminishes to zero and the gaps are restored to their original distances as the ring and block material fully relaxes and regains its original shape and configuration.

The following examples are illustrative of the teachings of this invention.

EXAMPLE I

A breech mechanism having a general configuration as illustrated in FIG. 4 and embodying a lug arrangement as illustrated in FIG. 3 was fabricated in accordance with the teachings of this invention.

The material comprising the breech ring body was a 4340 alloy steel whose mechanical properties included a yield strength of 163.8 ksi at 0.1% offset, a 45.7% ra (reduction in area), and a charpy impact value of 20.0 ft-lb at −40 degrees Centigrade.

The material comprising the breech block body was also a 4340 alloy steel. However, the mechanical properties were a yield strength of 161.6 ksi at 0.1% offset, a 39.0% ra, and a charpy impact value of 21.8 ft-lb at −40 degrees Centigrade. The tie and mounting bars were of the same material.

Bearing surfaces, or pressure flanks of lugs 56, 56', 62 and 62' were inclined at an angle "A" of 20.0 plus or minus 0.14 degrees. Respective pairs of opposed pressure flanks were spaced, or gapped, 0.004 plus or minus 0.002 inches when the breech mechanism was in a closed and locked condition. Bearing surfaces, or pressure flanks of lugs 58, 58', 64 and 64' were inclined at an angle "B" of 10.0 plus or minus 0.12 degrees. Respective pairs of opposed pressure flanks were spaced, or gapped, 0.004 plus or minus 0.002 inches when the breech mechanism was in a closed and locked condition. Bearing surfaces, or pressure flanks 110, 110', 116, and 116' were inclined at an angle "G" of 5.0 plus or minus 0.09 degrees. Respective pairs of opposed pressure flanks were in an abutting contact relationship when the breech mechanism was in a closed and locked condition.

The bearing height of lugs 56 and 56' was 0.365 inches. The bearing height of lugs 58 and 58' was 0.478 inches and for lugs 60 and 60' it was 0.590 inches. The pitch $P_1$ was 2.08 inches and the pitch $P_2$ was 1.68 inches.

A plurality of strain gages was mounted to various surface areas of the breech ring and block bodies to monitor the stress throughout the loading cycle. Particular emphasis was placed on the lug root areas.

A force of 2.0 million pounds was applied to the front face 52 of the breech block. The area of the face was 53.37 square inches. Upon application of the force, the stress immediately began to rise in and about lugs 60, 66, 60' and 66' as their respective pressure flanks were in an abutting contact relationship when the mechanism was in a closed and locked condition.

Simultaneously, the gaps were narrowing between other pairs of lugs. The readings recorded for lugs 58, 64, 58' and 64' indicated that the gap between these lugs closed prior to lugs 56, 62, 56' and 62'. The last gaps to close were those between the ends of the tie bar and the ring grooves (158, 154, 160 and 156).

The recorded strain gage readings disclosed a more uniform stress distribution throughout the entire mechanism assembly than similar prior art breech mechanism assembly configurations.

As the applied force on the front face of the block decreased, the ring and block began to regain their original shapes and the gaps reappeared in reverse order. Lugs 60 and 66, and 60' and 66' remained in contact.

Examination of the breech mechanism assembly revealed no visible cracks, scraping or metal galling. A review of the data from the strain gages revealed a much better stress distribution pattern throughout the block and ring than had been previously obtained with prior art breech mechanism assemblies.

The breech mechanism assembly was made ready to continue cyclic testing to failure. The applied maximum load was maintained at 2.0 million pounds (plus or minus 2%) for the duration of testing. The breech mechanism completed 37,300 cycles before failing. The test was stopped when the breech could no longer hold the test pressure.

A prior art breech mechanism of the same size was identically tested and failed after 10,750 cycles.

A visual examination of the bearing surfaces, or pressure flanks, did show some metal wear and galling. The closing and opening of the gaps between lug bearing surfaces occurred in the same manner for each cycle as noted during initial cyclic testing.

EXAMPLE II

A self-tying breech mechanism assembly was fabricated in accordance with the teachings of this invention and having a general configuration as illustrated in FIG. 5 and embodying a lug arrangement as illustrated in FIG. 6.

The material comprising the breech ring body and the breech block body was the same material as that utilized in example I.

The material comprising the breech ring body was a 4340 alloy steel whose mechanical properties included a yield strength of 167.9 ksi at 0.1% offset, a 47.3% ra (reduction in area), and a charpy impact value of 25.0 ft-lb at −40 degrees Centigrade.

The material comprising the breech block body was also a 4340 alloy steel. However, the mechanical properties were a yield strength of 168.0 ksi at 0.1% offset, a 44.0% ra, and a charpy impact value of 18.2 ft-lb at −40 degrees Centigrade.

Bearing surfaces, or pressure flanks of lugs 56, 56', 62 and 62' were inclined at an angle "A" of 20.0 plus or minus 0.14 degrees. Respective pairs of opposed pressure flanks were spaced, or gapped, 0.002 plus or minus 0.002 inches when the breech mechanism was in a closed and locked condition. Bearing surfaces, or pressure flanks of lugs 58, 58', 64 and 64' were inclined at an angle "B" of 10.0 plus or minus 0.12 degrees. Respective pairs of opposed pressure flanks were in an abutting contact relationship when the breech mechanism was in a closed and locked condition. Bearing surfaces, or pressure flanks 110, 110', 116, and 116' were inclined at an angle "G" of 127.0 plus or minus 0.14 degrees and the respective pairs of opposed pressure flanks were spaced, or gapped, 0.028 plus or minus 0.002 inches when the breech mechanism was in a closed and locked condition.

The bearing height of lugs 56 and 56' was 0.480 inches. The bearing height of lugs 58 and 58' was 0.400 inches and for lugs 202 and 202' it was 0.200 inches. The pitch $P_1$ was 1.640 inches and the pitch $P_2$ was 2.563 inches.

A plurality of strain gages was mounted to various surface areas of the breech ring and block bodies to monitor the stress throughout the loading cycle. Particular emphasis was placed on the lug root areas.

A force of 2.0 million pounds was applied to the front face 52 of the breech block. The area of the face was 43.34 square inches. Upon application of the force, the stress immediately began to rise in and about lugs 58, 64, 58' and 64' as their respective pressure flanks were in an abutting contact relationship when the mechanism was in a closed and locked condition. Simultaneously, the gaps were narrowing between other pairs of lugs. The readings recorded for lugs 56, 62, 56' and 62' indicated that the gap between these lugs closed prior to lugs 202, 204, 202' and 204' of the integral tie bar arrangement.

As the applied force on the front face of the block decreased, the ring and block began to regain their original shapes and the gaps reappeared in reverse order. Lugs 58 and 64, and 58' and 64' remained in contact.

Examination of the breech mechanism assembly revealed no visible cracks, scraping or metal galling. A review of the data from the strain gages revealed a much better stress distribution pattern throughout the block and ring than had been previously obtained with prior art breech mechanism assemblies.

The breech mechanism assembly was made ready to continue cyclic testing to failure. The applied maximum load was maintained at 2.0 million pounds (plus or minus 2%) for the duration of testing. The breech mechanism completed only 22,000 cycles before failing. The test was stopped when the breech could no longer hold the test pressure.

A visual examination of the bearing surfaces, or pressure flanks, showed severe metal wear and galling caused by excessive slippage and chafing between them. This severe wear caused a change in the gap distances which resulted in an uneven re-distribution of stresses and relatively early failure.

EXAMPLE III

A self-tying breech mechanism assembly, shown in FIG. 1, was fabricated having similar configuration and materials as the mechanism of example II with one exception. The location of the middle lug pressure flank was relocated to be in line with those of the front and rear lugs.

Results of the cyclic test identical to that performed on previous examples indicated insignificant slippage and galling of bearing surfaces. The breech mechanism assembly endured 51,500 cycles before failing.

We claim as our invention:

1. A breech mechanism comprising a breech ring and a sliding breech block;

said breech ring comprising a first body of material having a predetermined value of compliance, a longitudinal axis, front and rear surface areas disposed substantially perpendicular to said axis and two pairs of opposed spaced major surface areas disposed substantially parallel to said axes, said surface areas defining the outer surface area of the ring;

a plurality of walls formed in said body defining a cavity which extends entirely through said body from one major surface to the other major surface of one of the pairs of major opposed surfaces;

two of said plurality of walls being opposed to, and spaced from, each other and configured to define an interrupted internal thread of buttress form;

said sliding breech block comprising a second body of material having a predetermined value of compliance, a longitudinal axis, and an exterior surface comprising a front surface, a rear surface, a first pair of major opposed surfaces comprising top and bottom surfaces of said second body, and a second pair of major opposed surfaces comprising two side surfaces of said second body;

said side surfaces are configured to define a plurality of pairs of laterally extending lugs projecting outwardly from the center of said second body and configured to define an interrupted external thread of buttress form;

said sliding breech block is capable of slidable insertion into and slidable withdrawal from the cavity formed in the breech ring;

the pressure flank of each lug of at least one pair of said laterally extending lugs is spaced a predetermined distance from the pressure flank of a respective internal thread of said interrupted interal thread of the breech ring when the sliding block is inserted into the cavity of the breech ring and the breech mechanism is in a closed and locked condition prior to firing a cannon;

said pressure flank of each lug of said at least one pair of said laterally extending lugs and said pressure flank of said respective internal thread of said interrupted internal thread are in an abutting contact relationship with each other immediately after the firing of the cannon to transfer a predetermined portion of the load applied to the block by the forces generated by the firing of the cannon to a predetermined portion of the breech ring;

said pressure flanks of each lug of said at least one pair of said laterally extending lugs and said pressure flank of said respective internal thread of said interrupted thread return to their initial spaced predetermined distance relationship upon completion of firing the cannon, and the pressure flank of each lug of at least one other pair of the plurality of pairs of laterally extending lugs of the slide block is in an abutting contact relationship with the pressure flank of another respective internal thread of said interrupted internal thread of the breech ring prior to, during, and after firing of the cannon.

2. The breech mechanism of claim 1 wherein the pressure flank of each lug of at least one pair of the plurality of pairs of said laterally extending lugs is inclined at a predetermined angle, and the pressure flank of each one of the respective internal threads of the breech ring is inclined at the same predetermined angle.

3. The breech mechanism of claim 1 wherein a bearing height of the pressure flank of each of the lugs of the sliding breech block with respect to the pressure flank of each of the respective internal threads of the breech ring is constant.

4. The breech mechanism of claim 1 wherein a bearing height of the pressure flank of each of the lugs of at least one pair of the plurality of pairs of said laterally extending lugs of the sliding breech block with respect to the pressure flank of at least one respective internal thread of the breech ring is different than a bearing height of the pressure flank of each of the lugs of at least one other pair of the plurality of pairs of lugs of the sliding breech block with respect to the pressure flank of at least one of their respective internal threads of the breech ring.

* * * * *